US006906683B2

(12) United States Patent
Ikeda et al.

(10) Patent No.: US 6,906,683 B2
(45) Date of Patent: Jun. 14, 2005

(54) CIRCULAR POLARIZED WAVE RECEPTION ANTENNA

(75) Inventors: Masakazu Ikeda, Machida (JP); Hisamatsu Nakano, 4-6-7-101, Jousuiminami-cho, Kodaira-shi, Tokyo (JP); Akira Miyoshi, Hachioji (JP)

(73) Assignees: Hisamatsu Nakano, Kodaira (JP); Mitsumi Electric Co., Ltd., Tama (JP)

( * ) Notice: Subject to any disclaimer, the term of this patent is extended or adjusted under 35 U.S.C. 154(b) by 10 days.

(21) Appl. No.: 10/634,385

(22) Filed: Aug. 4, 2003

(65) Prior Publication Data

US 2004/0070545 A1 Apr. 15, 2004

(30) Foreign Application Priority Data

Aug. 7, 2002 (JP) ..... 2002-230160

(51) Int. Cl.[7] ..... H01Q 1/36
(52) U.S. Cl. ..... 343/895; 343/756
(58) Field of Search ..... 343/895, 756, 343/833, 834, 909

(56) References Cited

U.S. PATENT DOCUMENTS 6,181,286 B1 * 1/2001 Roscoe et al. ..... 343/725
2002/0118140 A1 * 8/2002 Ogawa et al. ..... 343/834

FOREIGN PATENT DOCUMENTS

| | | |
|---|---|---|
| JP | 2001-326523 A | 11/2001 |
| JP | 2001-339227 A | 12/2001 |
| JP | 2003-37430 A | 2/2003 |

* cited by examiner

*Primary Examiner*—Hoang V. Nguyen
(74) *Attorney, Agent, or Firm*—Frishauf, Holtz, Goodman & Chick, P.C.

(57) ABSTRACT

A circular polarized wave reception antenna has a monopole antenna having a pole portion and an ground plate for grounding one terminal of the pole portion and a polarization converting arrangement disposed around the monopole antenna. The polarization converting arrangement has a plurality of helical leads extending in a helical fashion along the pole portion with apart from the pole portion by a predetermined distance. Each of the helical leads has an end grounded in said ground plate. The helical leads are disposed at equal angular spaces around the pole portion. When a resonance wavelength λ is equal to 128.3 mm, the predetermined space is equal to 20 mm. Each helical lead has a length of λ/4. A pitch angle included between the ground plate and each helical lead is equal to 40 degrees.

8 Claims, 3 Drawing Sheets

CIRCULAR POLARIZED WAVE RECEPTION ANTENNA

BACKGROUND OF THE INVENTION

This invention relates to a digital radio receiver for receiving an electric wave from an artificial satellite (that may be called a "satellite wave") or an electric wave on the ground (that may be called a "terrestrial wave") to listen in a digital radio broadcasting and, in particular, to an antenna for use in the digital radio receiver.

In recent years, a digital radio receiver, which receives the satellite wave or the terrestrial wave to listen in the digital radio broadcasting, has been developed and is put to practical use in the United States of America. The digital radio receiver is mounted on a mobile station such as an automobile and can receive an electric wave having a frequency of about 2.338 gigahelts (GHz) to listen in a radio broadcasting. Inasmuch as a received electric wave has the frequency of about 2.338 GHz, the received electric wave has a reception wavelength (resonance wavelength) $\lambda$ of 128.3 mm.

In addition, the terrestrial wave is an electric wave in which a signal where the satellite wave is received in an earth station is retransmitted at a linear polarization.

In order to receive such an electric wave having the frequency of about 2.338 GHz, it is necessary to set up an antenna outside the automobile. Although such antennas have been proposed those having various structures, the antennas of cylindrical-type are generally used rather than those of planer-type (plane-type). It is possible to obtain a wider directivity by making a shape of the antenna cylindrical.

In the manner which is well known in the art, an electromagnetic wave emitted into a free space is a transversal wave having an electric field and a magnetic field vibrating in a plane perpendicular to a propagating direction of the wave. The electric field and the magnetic field are variable in intensity within the above-mentioned plane. Such electromagnetic wave in which the direction of the electric field is not random but constant or varied in some regular way is referred to as a polarized wave. The satellite wave is a circular polarized wave exhibiting circular polarization while the terrestrial wave is a linear polarized wave exhibiting linear polarization.

Now, the description will be mainly made as regards the antennas for receiving the satellite wave. A helical or helix antenna is known in the art as one of the antennas of the cylindrical-type. The helical antenna has structure where at least one antenna lead is wound around an outer peripheral surface of a hollow or solid cylindrical (which is collectively called "cylindrical") member in a helix fashion (spiral fashion). The helical antenna can effectively receive the above-mentioned circular polarized wave. Accordingly, the helical antenna is exclusively for use in receiving the satellite wave. The cylindrical member is made of an insulation material such as plastics. In addition, antenna leads are equal, for example, in number to four. On the other hand, it is remarkably difficult to really wind the plurality of antenna leads around the outer peripheral surface of the cylindrical member. Accordingly, alternatively, another helical antenna is proposed in which an antenna pattern film where a plurality of conductive patterns are printed or formed an insulation flexible sheet is wound around the outer peripheral surface of the cylindrical member.

Various helical antennas of the type are already proposed. By way of example, Japanese Unexamined Patent Publication Tokkai No. 2001-326523 or JP-A 2001-326523 discloses a helical antenna structure which improves a strength of structure by altering the cylindrical member of the helical antenna. More specifically, in order to resolve a problem in a conventional helical antenna having a week strength when the cylindrical member has a hollow cylindrical shape, the helical antenna structure disclosed in JP-A 2001-326523 disposes, between a center axis and an inner peripheral surface of the hollow cylindrical member, at least three ribs symmetrically extending in a radial manner at equal angular intervals.

In addition, Japanese Unexamined Patent Publication Tokkai No. 2001-339227 or JP-A 2001-339227 discloses a helical antenna which is capable of easily adjusting a resonance frequency of the helical antenna to a desired resonance frequency. More specifically, in JP-A 2001-339227, a hollow cylindrical member has a female threaded screw hole where an upper end portion of the cylindrical member is threaded in an inner peripheral wall of the hollow cylindrical member. A ceramic bolt having a relative permittivity of 10–100 is threaded in the female threaded screw. When the ceramic bolt is inserted in the female threaded screw of the hollow cylindrical member, it is possible to equivalently shorten a length of the hollow cylindrical member due to a wavelength shortening effect.

Furthermore, Japanese Unexamined Patent Publication Tokkai No. 2003-37430 or JP-A 2003-37430 discloses a helical antenna uses a cylindrical body formed an insulating film member which is rolled into a cylindrical shape without using the cylindrical member. The cylindrical body is fixedly disposed on a circuit board at an end in an axial direction.

Attention will be directed to a four-phase feed helical antenna which has four antenna leads wound around the outer peripheral surface of the cylindrical member. After the satellite wave (the circular polarized wave) is received by the four antenna leads as four received waves, the four received waves are phase shifted and combined a phase shifter (a phase converting circuit) to as to match phases of the four received waves to obtain a combined wave, and then the combined wave is amplified by a low-noise amplifier (LNA) to obtain an amplified wave which is delivered to a receiver body. A combination of the four-phase feed helical antenna, the phase shifter (the phase converting circuit), and the low-noise amplifier is called an antenna unit.

In other words, it is necessary for the helical antenna comprising a plurality of antenna leads to feed to each antenna lead and to combine circular polarized waved received by means of the phase shifter (the phase converting circuit) in order to drive the helical antenna. In the helical antenna, each antenna lead has a length which is selected from a range between 0.8–1.3$\lambda$.

On the other hand, as antenna for receiving the linear polarized wave, a monopole antenna is known which has an antenna length of $\lambda/4$ and which has an end grounded to an ground plate. The monopole antenna requires no phase converting circuit. However, the monopole antenna is unsuitable to receive the circular polarized wave because the monopole antenna is an antenna for exclusively receiving the linear polarized wave.

In the manner which is described above, the conventional helical antenna, which is an antenna for receiving the circular polarized wave, comprising a plurality of antenna leads is disadvantageous in that it is complicated in structure because the conventional helical antenna requires the phase converting circuit (the phase shifter) and so on in order to drive it.

Accordingly, an antenna enable to receive the circular polarized wave without using the phase converting circuit (the phase shifter) is desired.

SUMMARY OF THE INVENTION

It is therefore an object of the present invention to provide a circular polarized wave reception antenna requiring no phase converting circuit.

Other objects of this invention will become clear as the description proceeds.

The present co-inventors thought whether or not what structure is adopted to receive a circular polarized wave without using a phase converting circuit. In the manner which is described above, a monopole antenna is an antenna for exclusively receiving a linear polarized wave although the phase converting circuit is not necessary. Accordingly, only the monopole antenna is unsuitable to receive the circular polarized wave. However, the present co-inventors reached the conclusion that it ought to receive the circular polarized wave using the monopole antenna by disposing any means for converting the circular polarized wave into a linear polarized wave around the monopole antenna.

Various means may be used as the means for converting the circular polarized wave into the linear polarized wave. In this invention, as one example of such as polarization converting means, a plurality of helical leads wound in a helical fashion around a pole portion of the monopole antenna with apart from the pole portion by a predetermined distance is used.

Specifically, according to this invention, a circular polarized wave reception antenna comprises a monopole antenna comprising a pole portion extending in an axial direction and an ground plate for grounding one terminal of the pole portion. The pole portion has a length of $\lambda/4$, where $\lambda$ represents a resonance wavelength. Disposed around the monopole antenna, a polarization converting arrangement converts a circular polarized wave into a linear polarized wave.

In the above-mentioned circular polarized wave reception antenna, the polarization converting arrangement preferably may comprise a plurality of helical leads extending in a helical fashion along the pole portion with apart from the pole portion by a predetermined distance. Each of the helical leads has an end grounded in the ground plate. When the helical leads are equal in number two, the two helical leads may preferably be disposed at an angular space of 90 degrees around the pole portion. When the helical leads are equal in number three or more, the three or more helical leads may preferably be disposed at equal angular spaces around the pole portion. When the resonance wavelength is equal to 128.3 mm, the above-mentioned predetermined space may desirably be equal to 20 mm. Preferably, each helical lead may have a length of $\lambda/4$. Preferably, a pitch angle included between the ground plate and each helical lead may be laid in a range between 30 degrees and 50 degrees and desirably may be equal to 40 degrees.

DESCRIPTION OF THE PREFERRED EMBODIMENT

Figure 1:
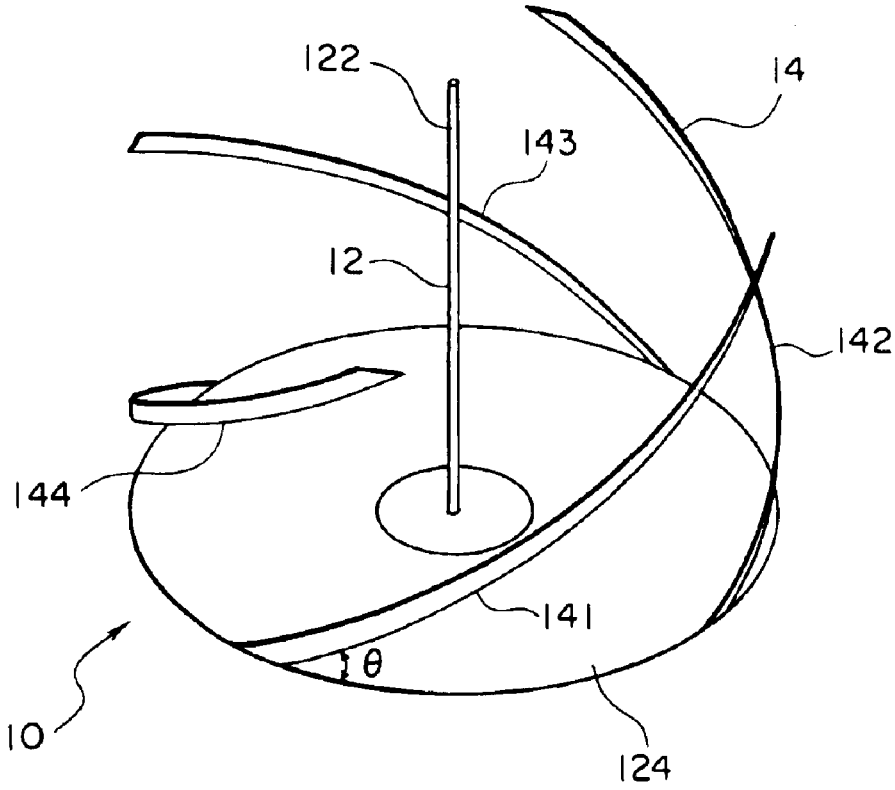
FIG. 1 is a perspective view showing a circular polarized wave reception antenna according to an embodiment of this invention.

Referring to FIG. 1, the description will proceed to a circular polarized wave reception antenna 10 according to a preferred embodiment of this invention.

The illustrated circular polarized wave reception antenna 10 comprises a monopole antenna 12 and a polarization converting arrangement 14.

The monopole antenna 12 comprises a pole portion 122 and a ground plate 124. The pole portion 122 extends in an axial direction and has a length of $\lambda/4$, where $\lambda$ represents a resonance wavelength. The ground plate 124 grounds one terminal of the pole portion 122. The polarization converting arrangement 14 is disposed around the monopole antenna 12. The polarization converting arrangement 14 converts a circular polarized wave into a linear polarized wave.

In the example being illustrated, the polarization converting arrangement 14 comprises first through fourth helical leads 141, 142, 143, and 144 which extend in a helical fashion along the pole portion 122 with apart from the pole portion 122 by a predetermined distance. Each of the first through the fourth helical leads 141–144 has an end which is grounded in the ground plate 124.

Figure 2:
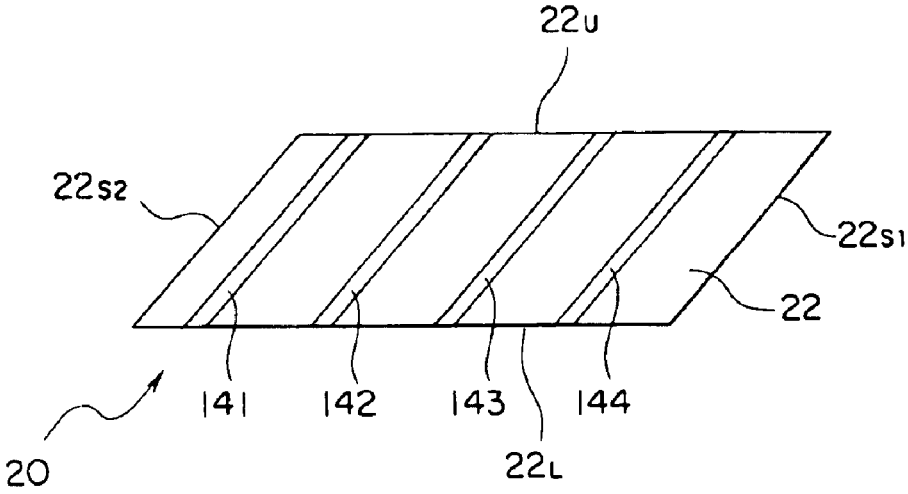
FIG. 2 is development showing an antenna pattern film used as a polarization converting arrangement for use in the circular polarized wave reception antenna illustrated in FIG. 1.

Referring to FIG. 2, the polarization converting arrangement 14 may comprise a cylindrical body formed by an antenna pattern film 20 which is rolled into a cylindrical shape. More specifically, the antenna pattern film 20 comprises a flexible insulator film member 22 for use in forming the cylindrical body. The insulator film member 22 is made, for example, of plastic such as polyimide.

The insulator film member 22 substantially has a parallelogram shape which has an upper side $\mathbf{22}_U$, a lower side $\mathbf{22}_L$, a first oblique side $\mathbf{22}_{S1}$, and a second oblique side $\mathbf{22}_{S2}$. By connecting the first oblique side $\mathbf{22}_{S1}$ with the second oblique side $\mathbf{22}_{S2}$, the cylindrical body is formed. This connection between the first oblique side $\mathbf{22}_{S1}$ and the second oblique side $\mathbf{22}_{S2}$ is carried out, for example, by using double-sided adhesive tape or an adhesive agent.

On one surface of the insulator film member 22, the first through the fourth helical leads 141–144 serving as an antenna pattern are formed so as to extend in parallel along the oblique sides. Accordingly, by forming the cylindrical body by rolling the antenna pattern film 22 into the cylindrical shape and by fixing the lower side $\mathbf{22}_L$ of the insulator film member 22 to the ground plate 124, the first through the fourth helical leads 141–144 are wound in the helical fashion along the pole portion 122 with apart from the pole portion 122 by the predetermined distance as shown in FIG. 1. In addition, by electrically and mechanically connecting an end of the lower side 22L of the first through the fourth helical leads 141–144 with the ground plate 124 by solder, the end of each of the first through the fourth helical leads 141–144 is grounded in the ground plate 124.

As shown in FIG. 1, the first through the fourth helical leads 141–144 are disposed at equal angular spaces of 90 degrees along said pole portion.

In other words, the monopole antenna 12 is disposed in a center of the first through the fourth helical leads 141–144, feeding is carried out only to the monopole antenna 12, and a lower portion of the first through the fourth helical leads 141–144 is short-circuited to the ground plate 124 of the monopole antenna 12.

In the manner which is described above, although only the monopole antenna 12 serves as a linear polarized wave reception antenna, polarization conversion occurs by disposing the first through the fourth helical leads 141–144 around the monopole antenna 12 and it results in receiving the circular polarized wave. That is, the polarization converting arrangement 14 comprising the first through the fourth helical leads 141–144 converts a received circular polarized wave into a converted linear polarized wave and the monopole antenna 12 receives the converted linear polarized wave.

Although the illustrated circular polarized wave reception antenna 10 is an antenna for receiving the circular polarized wave, the illustrated circular polarized wave reception antenna 10 may receive the linear polarized wave although its gain is degraded by 3 dB compared with a case of receiving the circular polarized wave.

It will be assumed that the resonance wavelength $\lambda$ is equal to 128.3 mm. In this event, the predetermined distance may preferably be 20 mm. In addition, although a pitch angle $\theta$ included between the ground plate 124 and each of the first through the fourth helical leads 141–144 is equal to 40 degrees in the example being illustrated, the pitch angle $\theta$ may be laid in a range between 30 degrees and 50 degrees. Furthermore, each of the first through the fourth helical leads 141–144 has a length of $\lambda/4$.

Figure 3:
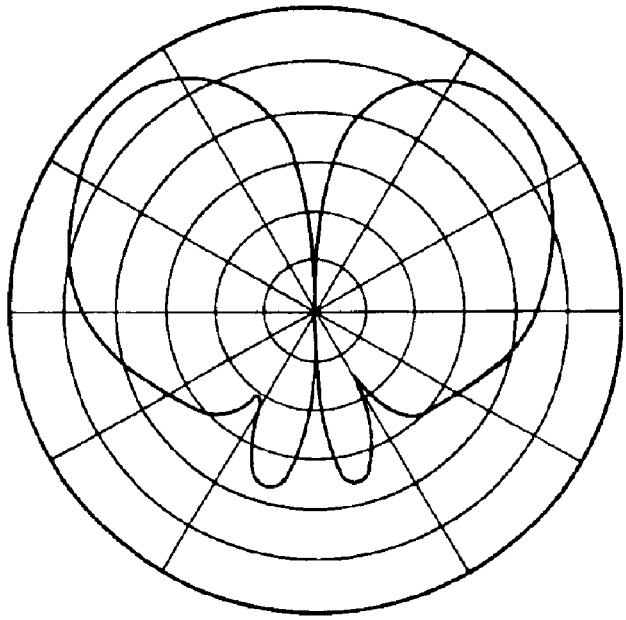
FIG. 3 is a view showing a radiation characteristic of the circular polarized wave reception antenna illustrated in FIG. 1.

FIG. 3 shows a radiation characteristic of the circular polarized wave reception antenna 10 illustrated in FIG. 1. As shown in FIG. 3, it is possible to obtain a bimodal circular polarization characteristic combining a linear polarization characteristic in a horizontal direction of the monopole antenna 12 by disposing the polarization converting arrangement 14 around the monopole antenna 12.

While this invention has thus far been described in conjunction with a preferred embodiment thereof, it will now be readily possible for those skilled in the art to put this invention into various other manners. For example, although description is made about a case where the helical leads are equal in number to four, the helical leads may be in number to two or more. If the helical leads are equal in number to two, the two helical leads may preferably be disposed at an angular space of 90 degrees around the pole portion. If the helical leads are equal in number to three or more, the three or more helical leads may preferably be disposed at equal angular spaces around the pole portion. At any rate, it is possible to adjust the radiation characteristic of the circular polarized wave reception antenna due to the number of the helical leads. In addition, it is possible to adjust the radiation characteristic of the circular polarized wave reception antenna by changing the pitch angle $\theta$, a winding diameter, and a length of the helical leads. The polarization converting arrangement for converting the circular polarized wave into the linear polarized wave is not restricted to the above-mentioned helical leads, the polarization converting arrangement may be another structure. For example, antenna leads may be obliquely disposed around the pole portion in lieu of winding in the helical fashion.

What is claimed is:

1. A circular polarized wave reception antenna comprising:

a monopole antenna comprising a pole portion extending in an axial direction and a ground plate for grounding one terminal of said pole portion, said pole portion having a length of $\lambda/4$, where $\lambda$ represents a resonance wavelength; and a polarization converting arrangement, disposed around said monopole antenna, for converting a circular polarized wave into a linear polarized wave;

wherein said polarization converting arrangement comprises a plurality of helical leads which helically extend along said pole portion and which are separated from said pole portion by a predetermined distance, wherein each of said helical leads includes an end which is grounded in said ground plate.

2. A circular polarized wave reception antenna as claimed in claim 1, wherein said plurality of helical leads comprise two helical leads, and said two helical leads are disposed around said pole portion with an angular distance of 90 degrees therebetween.

3. A circular polarized wave reception antenna as claimed in claim 1, wherein said plurality of helical leads comprise at least three helical leads, and said at least three helical leads are disposed around said pole portion with equal angular distances therebetween.

4. A circular polarized wave reception antenna as claimed in claim 1, wherein said resonance wavelength is 128.3 mm and said predetermined space is 20 mm.

5. A circular polarized wave reception antenna as claimed in claim 1, wherein each of said plurality of helical leads has a length of $\lambda/4$.

6. A circular polarized wave reception antenna as claimed in claim 1, wherein a pitch angle between said ground plate and each of said of said plurality of helical leads is between 30 degrees and 50 degrees.

7. A circular polarized wave reception antenna as claimed in claim 6, wherein said pitch angle is 40 degrees.

8. A circular polarized wave reception antenna as claimed in claim 1, wherein said polarization converting arrangement comprises a cylindrical body including an antenna pattern film which is rolled into a cylindrical shape, wherein said antenna pattern film comprises a flexible insulator film member having one surface on which said helical leads are formed, and wherein said pole portion is disposed in a substantially central portion of said cylindrical body.

* * * * *